US007443098B2

(12) United States Patent
Jeong

(10) Patent No.: US 7,443,098 B2
(45) Date of Patent: Oct. 28, 2008

(54) PLASMA DISPLAY PANEL WITH FIRST AND SECOND PHOSPHOR LAYERS RESPECTIVELY ON FIRST AND SECOND SUBSTRATE SURFACES

(75) Inventor: Kwang-Jin Jeong, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/331,110

(22) Filed: Jan. 13, 2006

(65) Prior Publication Data

US 2006/0186810 A1 Aug. 24, 2006

(30) Foreign Application Priority Data

Feb. 21, 2005 (KR) ..... 10-2005-0014084

(51) Int. Cl.
*H01J 17/49* (2006.01)

(52) U.S. Cl. ..... 313/582; 313/587; 315/169.4

(58) Field of Classification Search ..... 313/582–587, 313/512; 315/169.1, 169.4
See application file for complete search history.

(56) References Cited

U.S. PATENT DOCUMENTS 6,414,435 B1 * 7/2002 Akiba ..... 313/584
2004/0075375 A1 * 4/2004 Miyashita et al. ..... 313/231.31
2004/0145316 A1 * 7/2004 Nishitani et al. ..... 313/587
2004/0212302 A1 * 10/2004 Letz et al. ..... 313/512
2004/0234902 A1 * 11/2004 Toyoda et al. ..... 430/321

FOREIGN PATENT DOCUMENTS

| | | | |
|---|---|---|---|
| EP | 1 361 593 | | 11/2003 |
| JP | 09283030 | A * | 10/1997 |
| JP | 2000-208058 | | 7/2000 |
| JP | 2002-304950 | | 10/2002 |
| JP | 2003-272528 | | 9/2003 |
| JP | 2004-030949 | | 1/2004 |
| JP | 2004-296273 | | 10/2004 |

* cited by examiner

*Primary Examiner*—Toan Ton
*Assistant Examiner*—Hana A Sanei
(74) *Attorney, Agent, or Firm*—Lee & Morse, P.C.

(57) ABSTRACT

A plasma display panel (PDP) including a first substrate, a second substrate, a plurality of discharge cells arranged between the first substrate, a plurality of electrodes, and a plurality of phosphor portions, the second substrate arranged to at least partially overlap with the first substrate, the plurality of phosphor portions including a first group of the plurality of phosphor portions arranged on the first substrate, and a second group of phosphor portions arranged on the second substrate.

19 Claims, 11 Drawing Sheets

PLASMA DISPLAY PANEL WITH FIRST AND SECOND PHOSPHOR LAYERS RESPECTIVELY ON FIRST AND SECOND SUBSTRATE SURFACES

BACKGROUND OF THE INVENTION

1. Field of the Invention

The invention relates to a plasma display panel. More particularly, the invention relates to a plasma display panel having improved brightness and/or improved efficiency, including improved luminous efficiency and/or improved power efficiency.

2. Description of the Related Art

FIG. 1 illustrates an exploded perspective view of a plasma display panel (PDP), and FIG. 2 illustrates sectional views of the plasma display panel along lines II and II'-II' of FIG. 1.

The PDP includes a top panel 10 and a bottom panel 20 arranged opposite to the top panel 10. The top panel 10 and the bottom panel 20 may respectively have a top substrate 11 and a bottom substrate 21. Pairs of discharge electrodes 16 may be disposed on a bottom surface of the top substrate 11. A top dielectric layer 14 may cover the pairs of the discharge electrodes 16 and a passivation layer 15 may cover the top dielectric layer 14. Address electrodes 22 and a bottom dielectric layer 23 may be formed on a top surface of the bottom substrate 21. The address electrodes 22 may extend along a direction perpendicular to a direction along which the pairs of the discharge electrodes 16 extend. The bottom dielectric layer 23 may cover the address electrodes 22. Barrier ribs 24 may be formed on the bottom dielectric layer 23 to partially define a plurality of discharge cells 40. A portion of each of the discharge cells may be coated with a respective one of the phosphor layers 25. Portions of the bottom dielectric layer 23 between respective ones of the barrier ribs 24 and side surfaces of the barrier ribs 24 may be coated with the phosphor layers 25. The phosphor layers 25 may include red phosphor layers 25R, green phosphor layers 25G, and blue phosphor layers 25B. The discharge cells 40 may be classified as either a red discharge cell 40R, a green discharge cell 40G, or a blue discharge cell 40B.

Referring to FIG. 2, when a predetermined AC voltage is applied between two discharge electrodes 16, a sustain discharge F may occur between the two discharge electrodes 16. This sustain discharge F generally produces vacuum ultraviolet (VUV) light. The VUV light may excite the phosphor layers 25 to emit visible light, thereby forming an image.

In general, only about 50% (a) of the generated VUV light excites the phosphor layers 25 and the remaining VUV light (b) is emitted outside through the top substrate 11. As a result of the generated VUV light that is emitted through the top substrate 11, power may be wasted and the luminous efficiency and/or the brightness of the PDP may be reduced.

The above information disclosed in this Background section is only provided to aid in the understanding of one or more aspects of the invention, and is not to be considered nor construed as constituting prior art.

SUMMARY OF THE INVENTION

The present invention is therefore directed to a plasma display panel, which substantially overcomes one or more of the problems due to the limitations and disadvantages of the related art.

It is therefore a feature of an embodiment of the invention to provide a plasma display panel with improved luminance.

It is therefore another feature of an embodiment of the invention to provide a plasma display panel with improved power consumption relative to known plasma display panels.

At least one of the above and other features and advantages of the present invention may be realized by providing a plasma display panel (PDP) including a first substrate, a second substrate that may be arranged to be at least partially overlapping with the first substrate, a plurality of discharge cells that may be arranged between the first substrate and the second substrate, a plurality of electrodes that may be arranged between the first substrate and the second substrate, and a plurality of phosphor portions. The plurality of phosphor portions may include a first group of the plurality of phosphor portions arranged on the first substrate, and a second group of phosphor portions arranged on the second substrate.

The phosphor portions of the first group may be at least one of arranged on a first surface of the first substrate facing the second substrate, arranged on a second surface of the first substrate opposite to the first surface and/or arranged within the first substrate between the first surface and the second surface. The phosphor portions of the first group may have a thickness of about or less than 20 μm. Each of the discharge cells may include a respective portion of the phosphor portions of the first group and a respective portion of the phosphor portions of the second group at least partially overlapping the respective portion of the phosphor portions of the first group. The respective portions of the phosphor portion of the first group and the phosphor portion of the second group associated with each of the discharge cells may correspond to a same color. The first group of phosphor portions and the second group of phosphor portions may each include red phosphor portions, green phosphor portion and blue phosphor portions.

The phosphor portions of the second group may be arranged on respective portions of a surface of the second substrate facing the first substrate. A plurality of barrier ribs may be arranged between the first substrate and the second substrate to at least partially define respective boundaries of the plurality of discharge cells. The phosphor portions of the second group may be arranged on the respective portions of the surface of the second substrate facing the first substrate and at least a portion of at least one respective surface of the barrier ribs associated with each of the plurality of discharge cells.

The phosphor portions of the first group may have a thickness that is smaller than a thickness of the phosphor portions of the second group. The phosphor portions of the first group have a lower density than a density of the phosphor portions of the second group. The phosphor portions of the first group and the phosphor portions of the second group may be divided by barriers. The barriers separating the phosphor portions of the first group may be first barriers and the first barriers and the first substrate may be made of a same material. The first barriers may have a thickness that is the same as a thickness of the phosphor portions of the first group. The barriers separating the phosphor portions of the second group may be second barriers and the first barriers at least partially overlap the second barriers.

The first substrate may be an image display plane. The plurality of electrodes may include address electrodes extending along a second direction on a side of the second substrate facing the first substrate, the first direction crossing the second direction. The discharge electrodes may be covered with a first dielectric layer and the address electrodes may be covered with a second dielectric layer. In embodiments of the invention, first barriers may be arranged on one of the first dielectric layer or an outer surface of the first substrate, the first barriers may separate the phosphor portions of the first group from each other, and second barriers may be arranged on the second dielectric layer. Some of the phosphor portions of the first group may cover at least portions of the second barriers and at least portions of the second dielectric layer.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
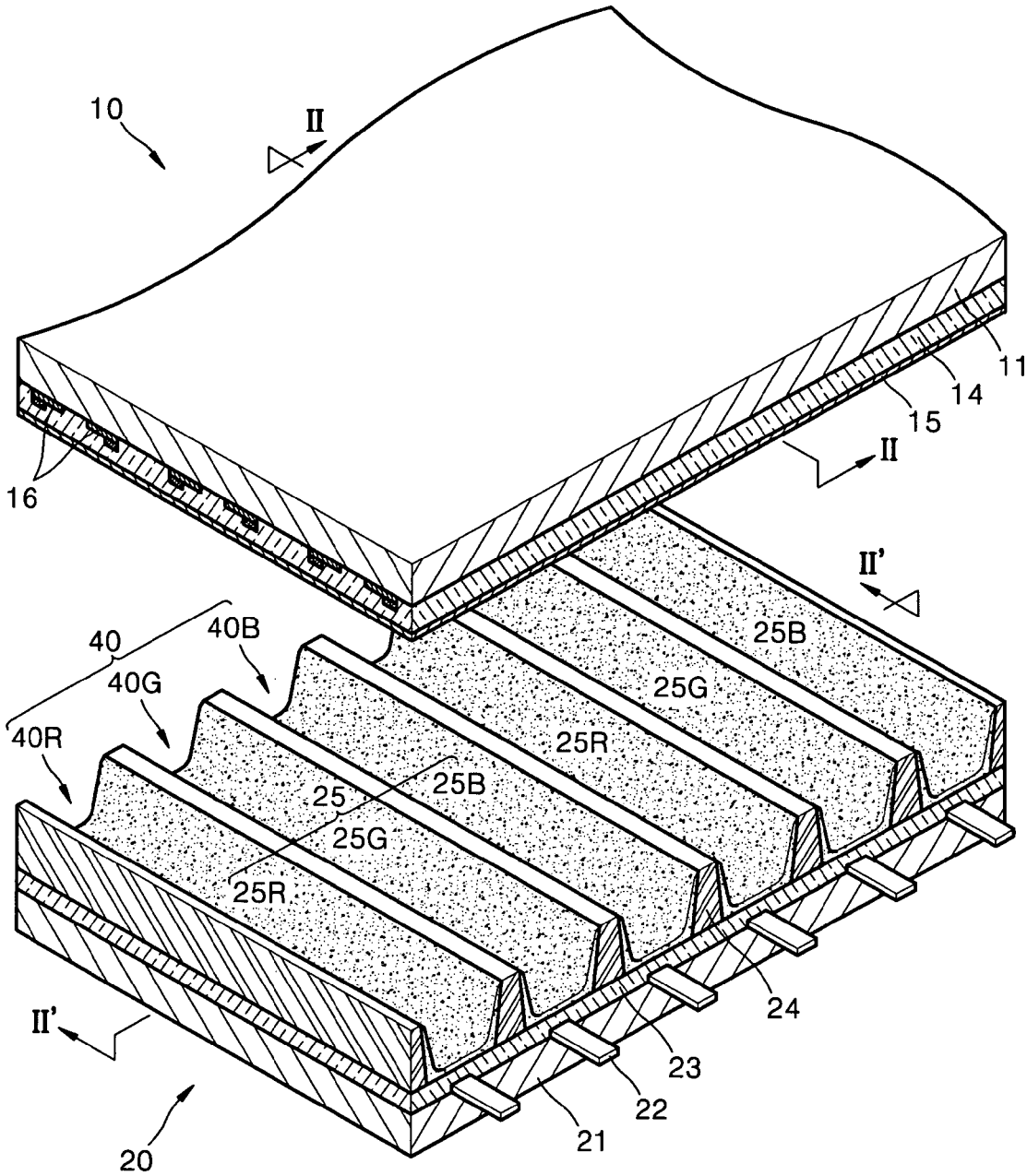
FIG. 1 (RELATED ART)
FIG. 1 illustrates an exploded perspective view of a known PDP.
Figure 2:
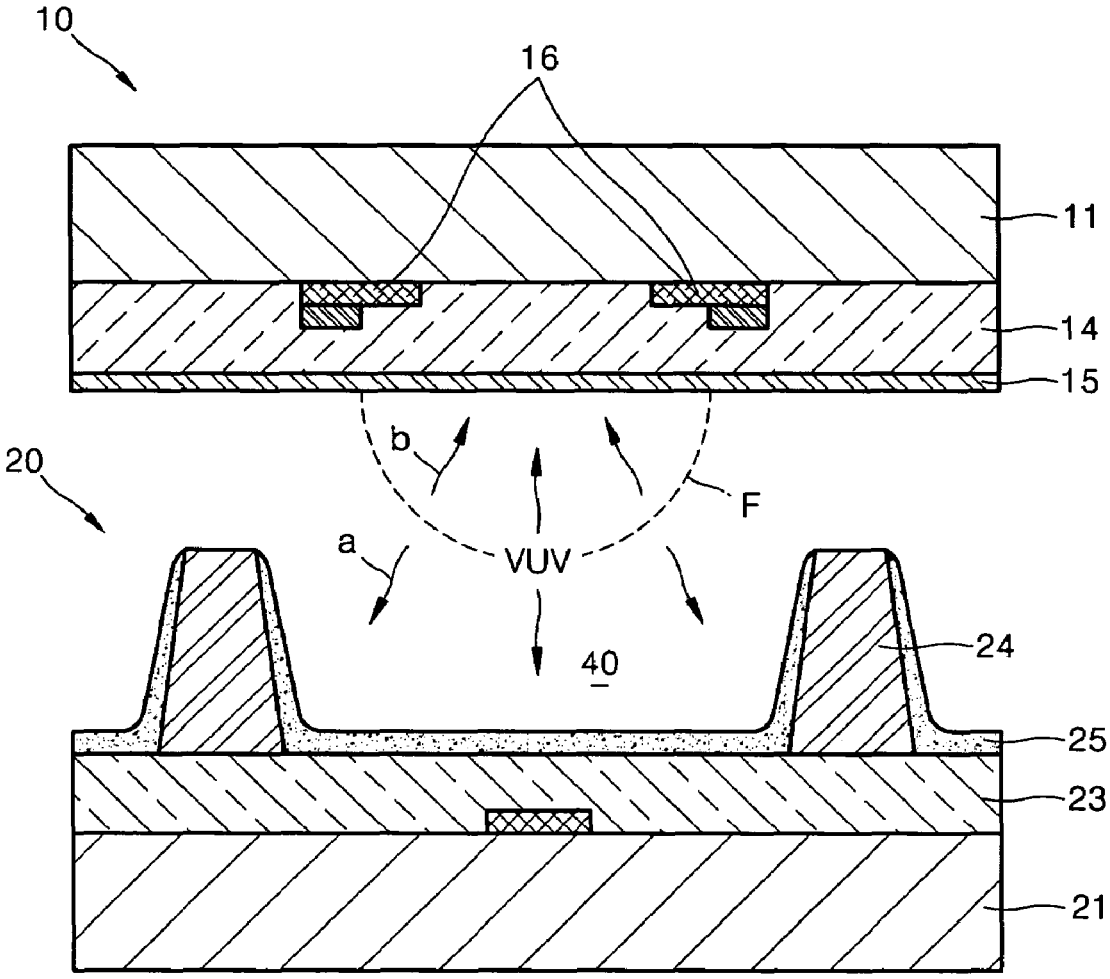
FIG. 2 (RELATED ART)
FIG. 2 illustrates sectional views of the PDP along lines II-II and II'-II' of FIG. 1.

Korean Patent Application No. 10-2005-0014084, filed on Feb. 21, 2005, in the Korean Intellectual Property Office, and entitled, "Plasma Display Panel," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. It will further be understood that when a first layer of object overlaps a second layer or object, the first layer or object may be arranged directly on the second layer or object, or a space and/or one or more intervening layers or objects may exist between the first layer or object and the second object or layer. Also, any reference to a relative position or direction, such as, "top" or "bottom" is solely provided as an aid to understanding the invention and in is in no way intended to limit the feature(s) to such an orientation or position. Like reference numerals refer to like elements throughout.

Figure 3:
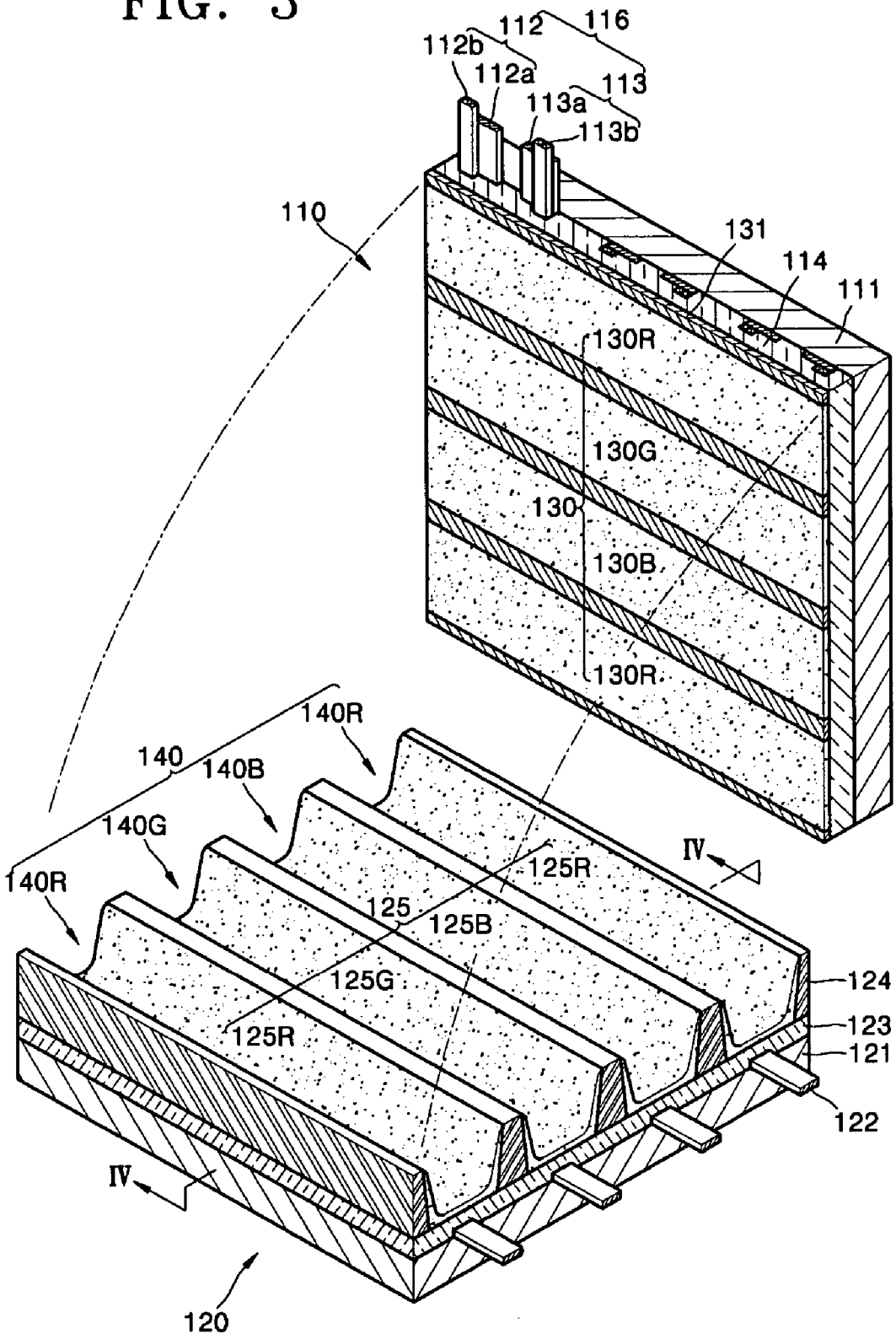
FIG. 3 illustrates an exploded perspective view of a PDP according to a first embodiment of the invention.
Figure 4:
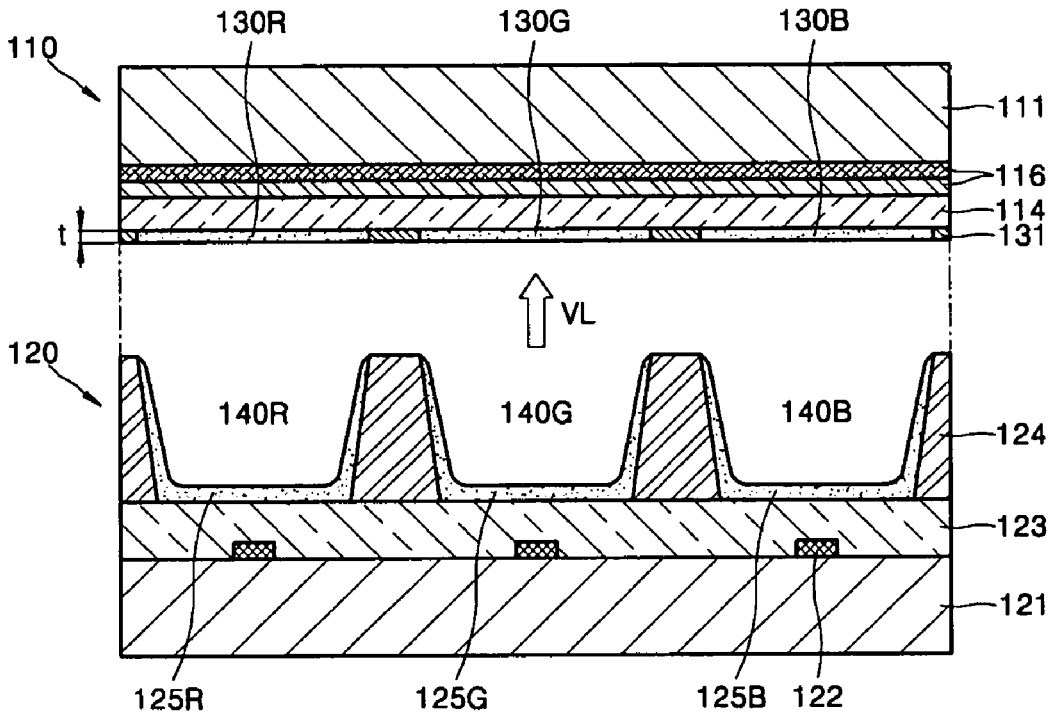
FIG. 4 illustrates a sectional view of the PDP along line IV-IV of FIG. 3.

FIG. 3 illustrates an exploded perspective view of a PDP according to a first embodiment of the invention and FIG. 4 is a sectional view of the PDP along line IV-IV of FIG. 3. The PDP may include a bottom panel 120 and a top panel 110. The top panel 110 may be arranged to face the bottom panel 120. The top panel 110 may include a top substrate 111. The bottom panel 120 may include a bottom substrate 121, address electrodes 122, a bottom dielectric layer 123 and barrier ribs 124. The address electrodes 122 may be arranged on the bottom substrate 121 in a predetermined pattern. The bottom dielectric layer 123 may cover the address electrodes 122. The barrier ribs 124 may be arranged on the bottom dielectric layer 123.

The bottom substrate 121 may support the address electrodes 122 and the bottom dielectric layer 123. The address electrodes 122 may produce an address discharge to help a discharge, e.g., a sustain discharge, take place between respective discharge electrodes 116. The address electrodes 122 may help lower a voltage to be employed for the sustain discharge. The address electrodes 122 may be formed in a striped pattern extending along one direction.

The bottom dielectric layer 123 may reduce and/or prevent the address electrodes 122 from damage that may occur, for example, when positive ions or electrons collide against the address electrodes 122 during the address discharge and/or the sustain discharge. In embodiments of the invention, the bottom dielectric layer 123 may be formed, for example, of PbO, $B_2O_3$, or $SiO_2$.

The barrier ribs 124 may be arranged on an upper surface of the bottom dielectric layer 123. The barrier ribs 124 may be arranged in a striped pattern extending along one direction. The barrier ribs 124 may be arranged between the top substrate 111 and the bottom substrate 121, and may at least partially define discharge cells 140. For example, the barrier ribs 124, together with the top substrate 111 and the bottom substrate 121, may define boundaries of the discharge cells. Although the barrier ribs 124 may be formed parallel to each other, the invention is not limited to such an open barrier rib structure. For example, the barrier ribs 124 may be constructed with a closed barrier rib structure, e.g., a matrix pattern.

Bottom phosphor layers 125 and top phosphor layers 130 may both be provided in the discharge cells 140. In embodiments of the invention, each discharge cell may include a corresponding portion of the bottom phosphor layer 125 and a corresponding portion of the top phosphor layer 130. The corresponding portions of the upper and lower discharge cells 140 may overlap each other.

For example, the bottom phosphor layers 125 may be formed on the upper portion (e.g., upper surface) of the bottom dielectric layer 123 and on the respective sidewalls of the barrier ribs 124. The bottom phosphor layers 125 may convert vacuum ultraviolet (VUV) light generated by the gas discharge into visible light. The bottom phosphor layers 125 may include red phosphor layers 125R, green phosphor layers 125G and blue phosphor layers 125B. The red phosphor layers 125R may be made, for example, of $Y(V,P)O_4$:Eu and the green phosphor layers 125G may be made, for example, of $Zn_2SiO_4$:Mn or $YBO_3$:Tb. The blue phosphor 125B may be made, for example, of BAM:Eu.

The red, green and blue phosphor layers 125R, 125G and 125B may be separated from one another by the barrier ribs 124. The discharge cells may include red discharge cells 140R, green discharge cells 140G, and blue discharge cells 140B that respectively correspond to the color of the phosphor layer 125R, 125G and 125B associated with the respective discharge cell. The red discharge cells 140R, the green discharge cells 140G, and the blue discharge cells 140B may be separated from one another by the barrier ribs 124. Although not shown, a discharge gas, such as Ne, Xe and a mixture gas thereof, may fill the discharge cells 140R, 140G and 140B.

The top panel 110 may include a top substrate 111, discharge electrodes 116, a top dielectric layer 114 and top phosphor layers 130. The discharge electrodes 116 may be arranged in a predetermined pattern on, for example, a lower portion of the top substrate 111. A top dielectric layer 114 may cover the discharge electrodes 116. The top phosphor layers 130 may be arranged on a lower portion (e.g., lower surface) of the top dielectric layer 114.

The top substrate 111 may be formed of a glass. The discharge electrodes 116 may be arranged in pairs and the pairs may be arranged parallel to each other with a predetermined distance between them. Each of such pairs of the discharge electrodes 116 may include a sustain electrode 112, and a scan electrode 113. The sustain electrode 112 may include a transparent electrode 112*a* and a bus electrode 112*b*. The scan electrode 113 may include a transparent electrode 113*a* and a bus electrode 113*b*. In some embodiments of the invention, the sustain electrodes 112 and the scan electrodes 113 may be provided with only the bus electrode, i.e., without the transparent electrode.

The transparent electrodes 112*a* and 113*a* may be made of a transparent conductive material, e.g., indium tin oxide (ITO). Such transparent conductive materials may cause a discharge and do not block light emission from the phosphor layers toward the top substrate 111. The bus electrodes 112*b* and 113*b* may be formed of a conductive metal and may contact the transparent electrodes 112*a* and 113*b*, respectively. The bus electrodes 112*b* and 113*b* may enhance an electrical conductivity of the discharge electrodes 116 and may be made of a metal having good conductivity. For example, the bus electrodes 112*b* and 113*b* may be formed of a single metal layer of Al or Ag, or of a triple metal layer of Cr—Cu—Cr.

The top dielectric layer 114 may reduce and/or prevent the sustain electrode 112 and the scan electrode 113 from contacting each other. The top dielectric layer 114 may reduce and/or prevent the discharge electrodes 116 from being damaged when positive ions or electrons collide against the discharge electrodes 116. The top dielectric layer 114 may help an accumulation of wall charges by guiding electric charges. The top dielectric layer 114 may be formed of a dielectric material, e.g., PbO, $B_2O_3$ and $SiO_2$.

The top phosphor layers 130 may be formed below the top dielectric layer 114. For example, the top phosphor layers 130 may be formed on a bottom surface of the dielectric layer 114. The bottom phosphor layers 125, the top phosphor layers 130 may include red phosphor layers 130R, green phosphor layers 130G and blue phosphor layers 130B. The red phosphor layers 130R, the green phosphor layers 130G, and the blue phosphor layers 130B may be separated from one another by color separators 131. The color separators 131 may be members that extend parallel to the barrier ribs 124. In embodiments of the invention, the separators 131 may respectively overlap at least a portion of the barrier ribs 124.

The red phosphor layers 130R, the green phosphor layers 130G, and the blue phosphor layers 130B may be respectively formed in the red discharge cells 140R, the green discharge cells 140G and the blue discharge cells 140B. The top phosphor layers 130 may convert VUV light generated by the sustain discharge into visible light. The top phosphor layers 130 may help reduce and/or prevent the VUV light from leaking through the top substrate 111. By reducing and/or preventing the VUV light from leaking through the top substrate 111, the luminous efficiency of the PDP may be enhanced.

Referring to FIG. 4, the top phosphor layers 130 may be formed to have one or more predetermined dimensions (e.g., thickness (t)) to help minimize and/or prevent any degradation in the transmission of the visible light as a result of the top phosphor layers 130. For example, the top phosphor layers 130 may each have a thickness (t) of about or less than 20 μm, where thickness (t) of the top phosphor layer 130 may be a distance that the top phosphor layer 130 extends toward the bottom substrate 121 along a direction perpendicular to the top substrate 111. The thickness (t) of the top phosphor layers 130 may be controlled by adjusting a thickness (h) of the color separator 131, as shown in FIG. 5.

Another approach for minimizing the reduction of visible light transmission due to the top phosphor layers 130, is to provide top phosphor layers 130 with a low density. The top phosphor layers 130 may be formed using a phosphor paste. The phosphor paste may include a phosphor powder and an organic binder constituting a vehicle. The phosphor paste may include other additives. When forming the top phosphor layers 130, a vacant space between the phosphor powders can be controlled by controlling a grain size and/or density of the phosphor powder. By controlling a grain size and/or density of the phosphor powder, the transmittance of the visible light can be increased based on the amount of vacant space between the phosphor powders.

In some embodiments of the invention, although the top phosphor layers 130 may reduce the transmission of visible light out from the discharge cells, by reducing and/or preventing the VUV light from leaking from the discharge cells, the degradation in the transmittance of the visible light due to the top phosphor layers 130 can be substantially or completely compensated for by an increase in the luminous efficiency of the discharge cell.

In embodiments of the invention including the top phosphor layers 130, the color separator 131 may or may not be included. The color separator(s) 131 may be employed to reduce and/or prevent the phosphor layers 130 from mixing with each other. The color separators 131 may be formed of a glass material. The color separators 131 and the barrier ribs 124 may be made of a same material. In embodiments of the invention, a black pigment may be included in the material(s) used to make the color separators 131. The black pigment may serve as a black stripe to help improve contrast of the PDP.

Figure 5A:
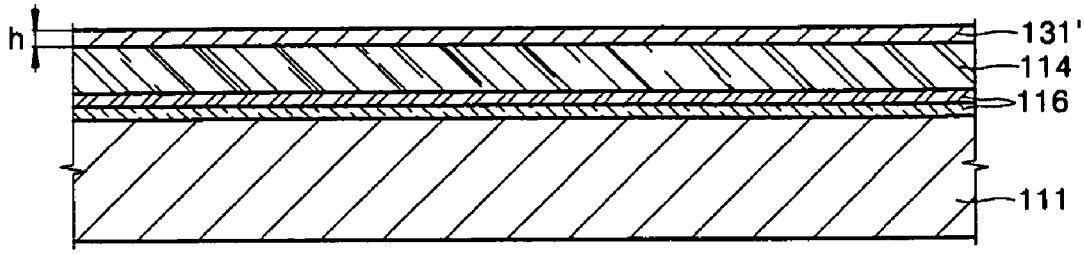
FIGS. 5A through 5D illustrate sectional views of an exemplary process of forming the exemplary embodiment of the top phosphor layer employed by the PDP shown in FIG. 3.
Figure 5B:
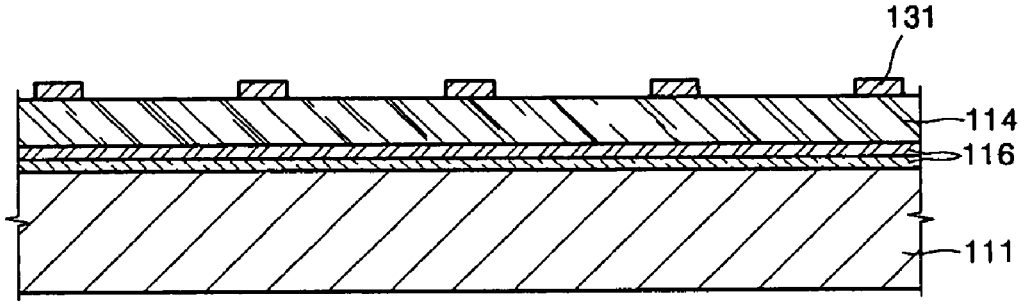
Figure 5C:
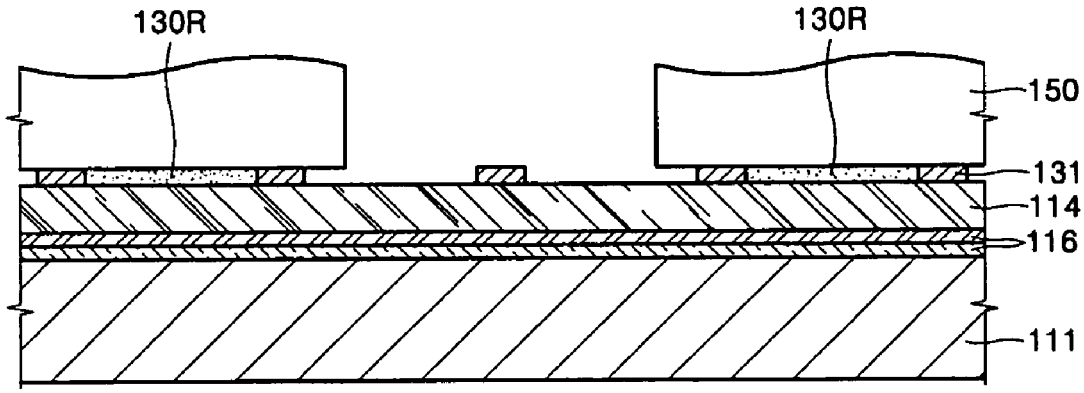
Figure 5D:
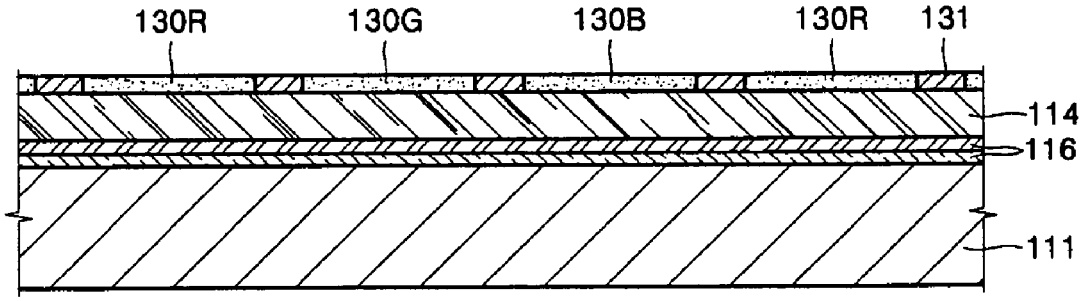

An exemplary process for forming the top phosphor layers 130 will be described with reference to FIGS. 5A through 5D. As shown in FIG. 5A, a paste 131' for the color separator may be deposited on the top dielectric layer 114. The paste 131' may be deposited to a predetermined thickness (h). As shown in FIG. 5B, the paste 131' may be patterned to form the color separators 131 in a predetermined pattern. This patterning process can be performed using, for example, photo-lithography. As shown in FIG. 5C, the phosphor paste, e.g., the red phosphor paste, may be placed on the dielectric layer 114 between the color separators 131. A planarization member 150 may be arranged on respective ones of the color separators 131, thereby forming the red phosphor layers 130R. The green phosphor paste and the blue phosphor paste may be deposited between the color separators 131. In embodiments of the invention, each of the different colored phosphor pastes may be sequentially deposited between respective ones of the color separators 131. The different colored phosphor pastes may be, for example, sequentially planarized to form the respective colored phosphor layer. For example, in the exemplary embodiment illustrated in FIG. 5D, the green phosphor paste and the blue phosphor paste may be pressed using a planarization member to form the green phosphor layers 130G and the blue phosphor layers 130B.

Figure 6:
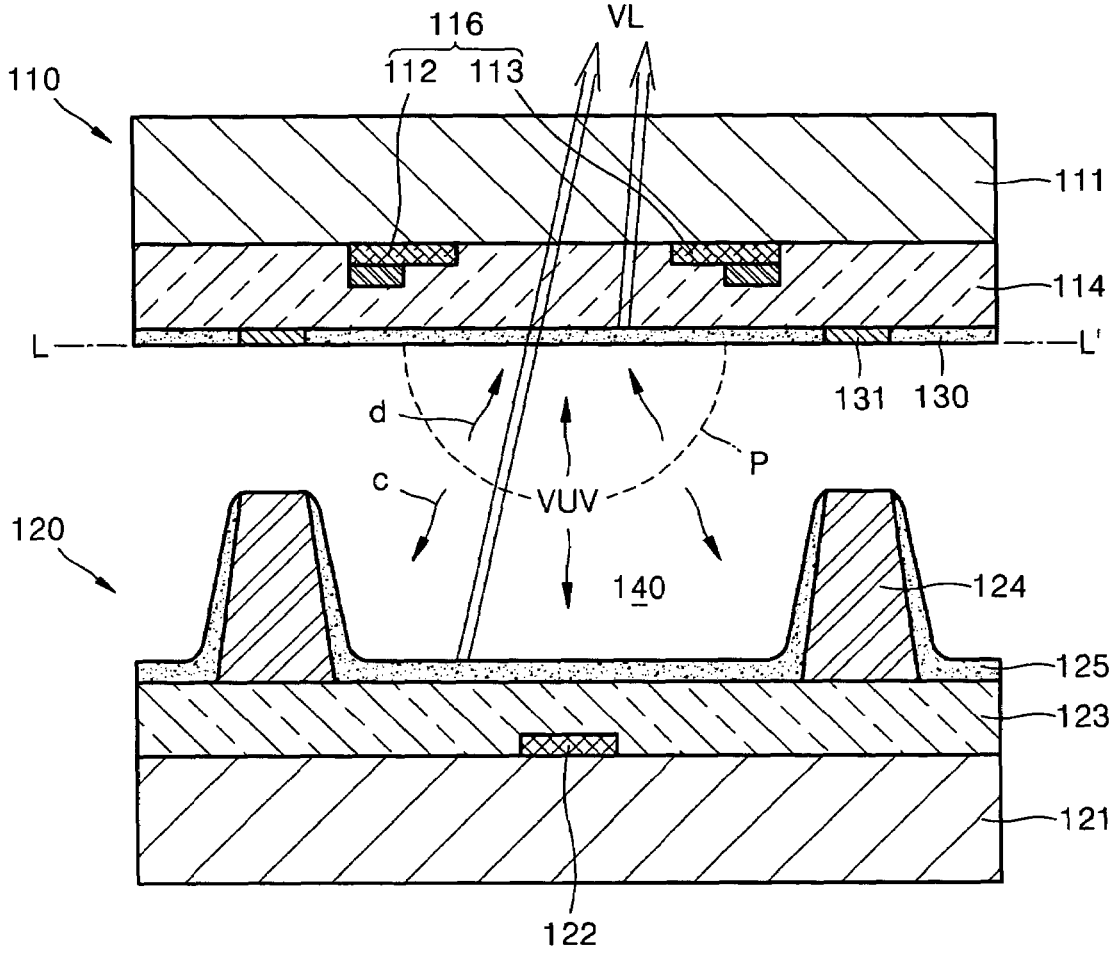
FIG. 6 illustrates a sectional view of each panel of a discharge cell shown in FIG. 4.

FIG. 6 illustrates a sectional view of the top panel 110 and the bottom panel 120 of the discharge cell shown in FIG. 4. For convenience, the top panel 110 (not including the color separators 131 and the phosphor layers 130) is turned by 90° with respect to the line L-L'. A method for driving the PDP may include one or more steps for implementing an address discharge and one or more steps for implementing a sustain discharge. The address discharge may be generated mainly between the scan electrode 113 and the address electrode 122. As a result of the address discharge, wall charges may accumulate in the selected ones of the discharge cells 140. The sustain discharge P may be generated between the pairs of the discharge electrodes 116 associated with each of the discharge cells 140. In embodiments of the invention, the sustain discharge P, together with the wall charges accumulated in the selected ones of the discharge cells 140, may cause VUV light to be emitted by the discharge gas in the selected ones of the discharge cells 140. The VUV light may excite the top phosphor layers 130 and/or the bottom phosphor layers 125. As shown in FIG. 6, the vacuum ultraviolet light (d) directed upward may excite the top phosphor layers 130, and the VUV light (c) directed downward may excite the bottom phosphor layers 125. The excited top and bottom phosphor layers 130 and 125 may then radiate visible light (VL).

The visible light (VL) may pass through the top substrate 111 and may form an image. In embodiments of the invention, by forming the phosphor layers 130 and 125 on the top and bottom of the discharge cell 140, an amount of the VUV light leaking out, i.e., not contributing to image formation, can be reduced or prevented. By reducing an amount of or preventing the vacuum ultraviolet light leaking from the discharge cells according to one or more aspects of the invention, the brightness level and/or the luminous efficiency of a PDP can be enhanced. For example, when a known PDP and a PDP employing one or more aspects of the invention employ the same amount of power, the PDP employing one or more aspects of the invention will be brighter than the known PDP. Although it may be possible to achieve the same brightness in a known PDP and a PDP employing one or more aspects of the invention, barring other influences, the PDP employing one or more aspects of the invention will require less power than the known PDP to provide that brightness.

Figure 7:
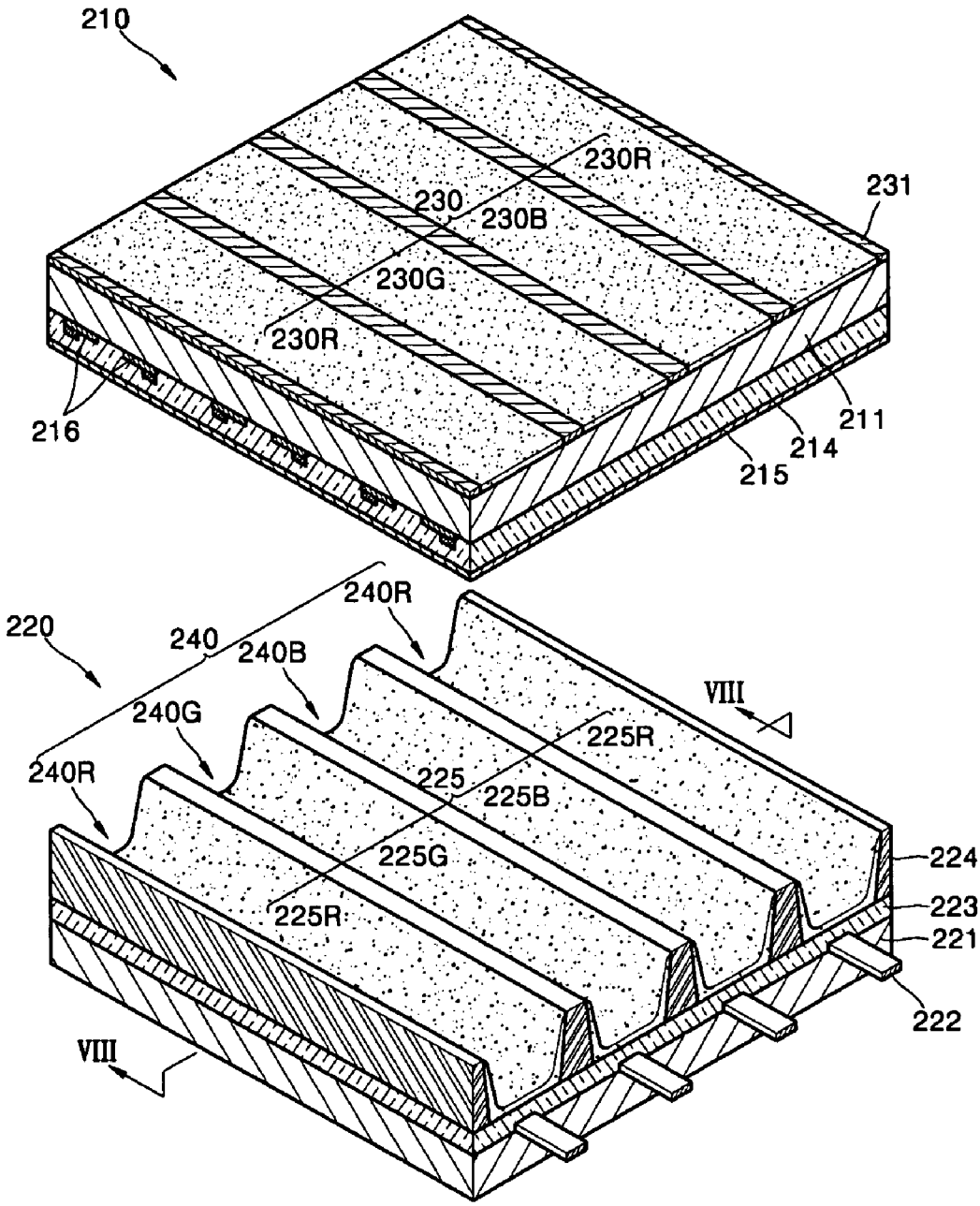
FIG. 7 illustrates an exploded perspective view of a PDP according to a second embodiment of the invention.
Figure 8:
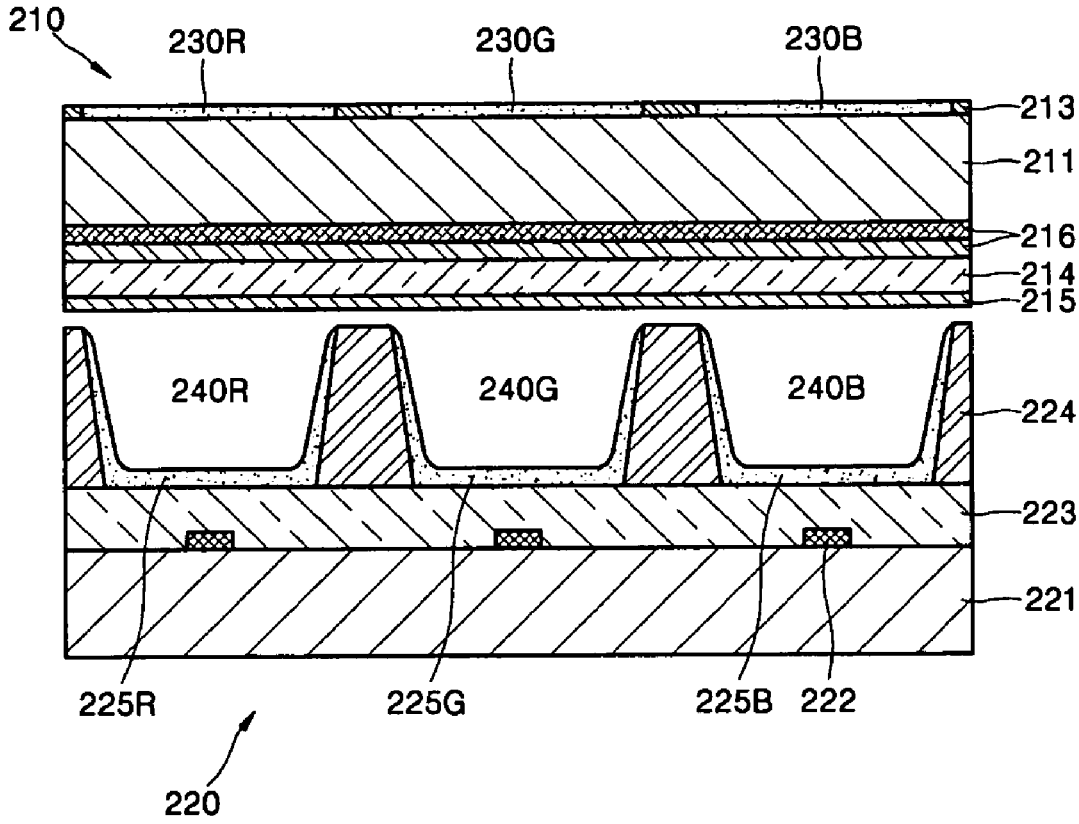
FIG. 8 illustrates a sectional view taken along line VIII-VIII of FIG. 7.

FIG. 7 illustrates an exploded perspective view of a PDP according to a second embodiment of the invention and FIG. 8 illustrates a sectional view of the PDP along line VIII-VIII of FIG. 7. Only differences between the embodiment illustrated in FIGS. 3-6 and the embodiment illustrated in FIGS. 7 and 8 will be described below.

Referring to FIGS. 7 and 8, top phosphor layers 230 and bottom phosphor layers 225 may be arranged opposite to each other on upper and lower sides of each discharge cell 240, respectively. For example, red top phosphor layers 230R and red bottom phosphor layers 225R may be formed on upper and lower sides of a red discharge cell 240R. Green top phosphor layers 230G and green bottom phosphor layers 225G may be formed on upper and lower sides of a green discharge cell 240G. Blue top phosphor layers 230B and blue bottom phosphor layers 225B may be formed on upper and lower sides of a blue discharge cell 240B.

On a top substrate 211, color separators 231 may be arranged in a pattern corresponding to barrier ribs 224. For example, the color separators 231 may be arranged to at least partially overlap respective ones of the barrier ribs 224. The different phosphor layers 230 may be separated from one another by the color separators 231. The top phosphor layers 230 may be formed on an upper portion (e.g., upper surface) of the top substrate 211, and the top phosphor layers 230 may not be exposed to discharge cells 240 where a discharge may occur. By providing the top phosphor layers 230 at a portion of the top substrate where the top phosphor layers 230 are not exposed to the discharge cells 240, a direct collision with charged particles can be prevented. It is possible to reduce and/or prevent a degradation of color purity and/or a shortening of a lifetime of the PDP, which are both generally caused by a degradation of the top phosphor layers 230, which may have a relatively low density and/or be thin layer(s).

A top dielectric layer 214 may be covered with a passivation layer 215. In some embodiments of the invention, the passivation layer 215 may not be provided. The passivation layer 215 may protect the top dielectric layer 214 from collisions with charged particles generated by a discharge. The passivation layer can be made, for example, of MgO.

Figure 9:
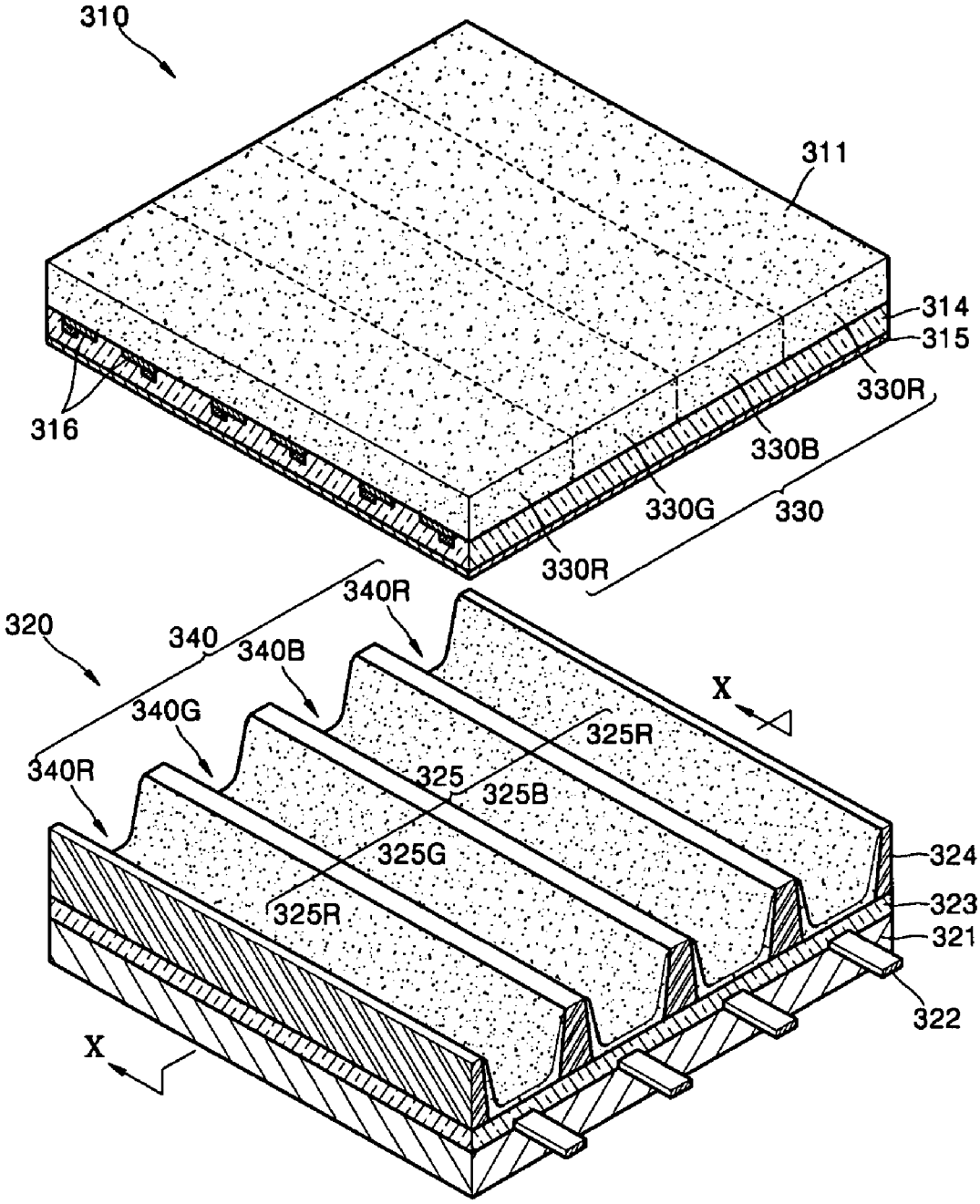
FIG. 9 illustrates an exploded perspective view of a PDP according to a third embodiment of the invention.
Figure 10:
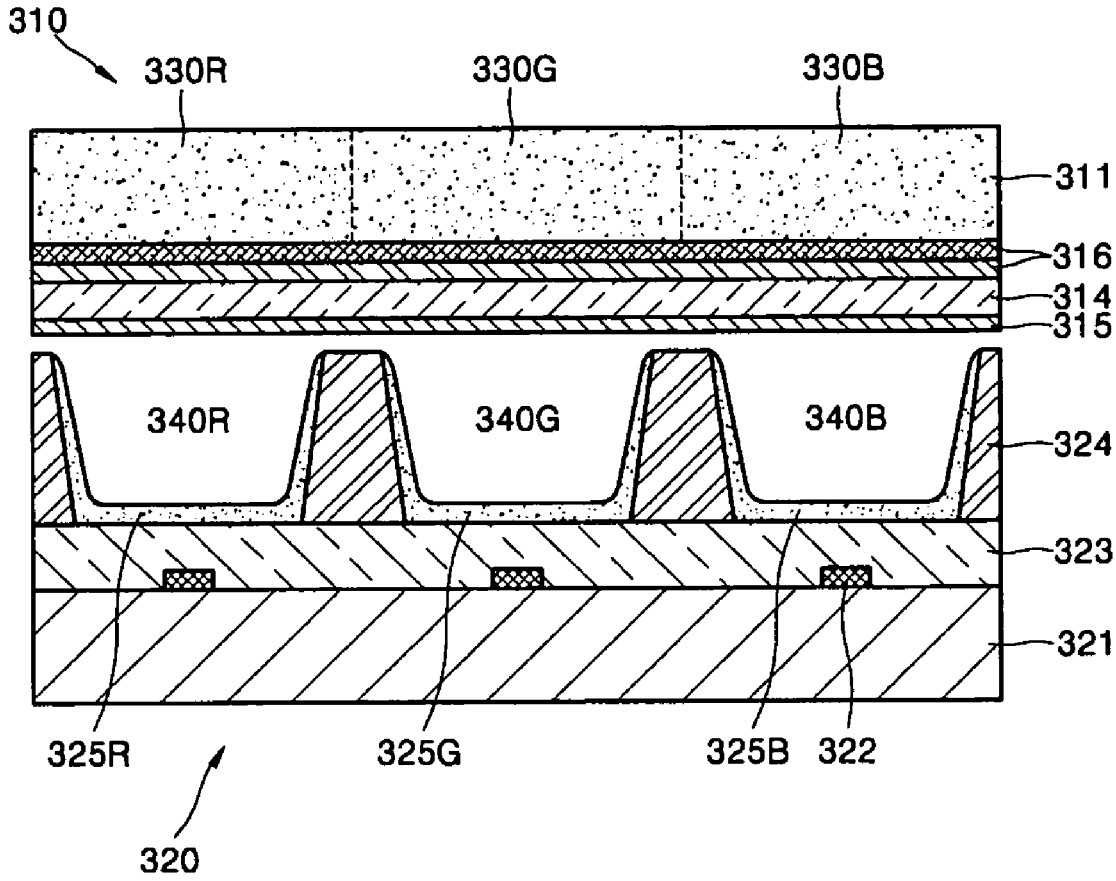
FIG. 10 illustrates a sectional view taken along line X-X of FIG. 9.

FIG. 9 illustrates an exploded perspective view of a PDP according to a third embodiment of the invention and FIG. 10 illustrates a sectional view of the PDP along line X-X of FIG.10. Only differences between the embodiment illustrated in FIGS. 3-6 and the embodiment illustrated in FIGS. 9 and 10 will be described below.

Referring to FIGS. 9 and 10, top phosphor layers 330 and bottom phosphor layers 325 may be arranged opposite to each other on upper and lower sides of each discharge cell 340, respectively. In embodiments of the invention, the top phosphor layers 330 may be included within the top substrate 311. The top substrate 311, which may transmit visible rays, may be made of a glass material. For example, to make the top substrate 311, a glass raw material and a phosphor powder may be molten together at about 900° C. and may be formed into a plate-like shape.

One way to help maximize the transmittance of the visible rays through the top substrate 311 is to adjust the grain size and the mixture ratio of phosphor powders contained in the glass raw material used to make the top substrate 311. In embodiments of the invention where the top phosphor layers 330 are contained within the top substrate 311, the same phosphor layers 330 and 325 may be provided in upper and lower sides of each discharge cell 340. In embodiments of the invention, the top phosphor layers 330 on the top substrate 311 may be formed to have the same arrangement as the bottom phosphor layers 325 on the bottom substrate 321. For example, red phosphor layers 330R and 325R may be arranged on upper and lower sides of a red discharge cell 340R. Green phosphor layers 330G and 325G may be arranged on upper and lower sides of a green discharge cell 340G. Blue phosphor layers 330B and 325B may be arranged on upper and lower sides of a blue discharge cell 340B. In embodiments of the invention, the dielectric layer 314 may be covered with a passivation layer 315 that may protect the top dielectric layer 314.

As shown in FIGS. 9 and 10, in embodiments of the invention, color separators may not be provided between respective ones of the top phosphor layers 330. In particular, in embodiments where the top phosphor layers 330 are contained within the top substrate 311, portions of the top substrate 311 may itself function as the color separators 131, 231 described above. In such embodiments where the color separators are not provided and/or are not necessary, the manufacturing processes and cost of manufacturing PDPs can be simplified and/or reduced.

Embodiments of the invention provide phosphor layers on substantially all sides of a discharge cell. Some or all of the discharge cell(s) may in a plasma display panel employing one or more aspects of the invention may include phosphor layers on upper and lower sides thereof. In comparison to known PDPs, embodiments of the invention provide a PDP in which leakage of vacuum ultraviolet rays can be reduced and/or prevented. PDPs employing one or more aspects of the invention provide improved brightness in relation to known PDPs when the same amount of power is employed by each. Barring other influences, PDPs employing one or more aspects of the invention employ less power to provide a same brightness level as a known PDP.

PDPs employing one or more aspects of the invention may achieve one or more of the above advantages while employing known driving methods. Embodiments of the invention provide high-grade PDPs that can be manufactured at a lower cost that known high-grade PDPs.

Embodiments of the invention reduce and/or prevent a reduction in color purity and luminescence by providing, for example, top and bottom phosphor layers on the upper and lower sides of the discharge cell, respectively. By reducing and/or preventing a degradation in color purity and luminescence, a degradation in a quality of the PDP due to an increase in the driving time can be minimized and/or the lifetime of the PDP can be extended.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel (PDP), comprising:

a first substrate having first and second surfaces facing one another;

a second substrate facing the first surface of the first substrate, the second substrate arranged to be at least partially overlapping with the first substrate;

a plurality of discharge cells arranged between the first substrate and the second substrate;

a plurality of electrodes arranged between the first substrate and the second substrate; and a plurality of phosphor portions including a first group of the plurality of phosphor portions arranged on the first substrate and a second group of the plurality of phosphor portions arranged on the second substrate, wherein the first group of phosphor portions are arranged between the first and second surfaces of the first substrate.

2. The plasma display panel as claimed in claim 1, wherein the first group of phosphor portions is an upper most layer within the first substrate, an outer surface of each of the phosphor portions of the first group being coextensive with the second surface of the first substrate.

3. The plasma display panel as claimed in claim 2, wherein the phosphor portions of the first group have a thickness of about 20 μm or less.

4. The plasma display panel as claimed in claim 2, wherein each of the discharge cells includes a respective portion of the phosphor portions of the first group and a respective portion of the phosphor portions of the second group, the respective portion of the phosphor portions of the second group at least partially overlapping the respective portion of the phosphor portions of the first group.

5. The plasma display panel as claimed in claim 4, wherein the respective portions of the phosphor portion of the first group and the phosphor portion of the second group associated with each of the discharge cells correspond to a same color.

6. The plasma display panel as claimed in claim 5, wherein the first group of phosphor portions and the second group of phosphor portions each include red phosphor portions, green phosphor portion and blue phosphor portions.

7. The plasma display panel as claimed in claim 1, wherein the second surface of the first substrate is an outer-most surface with respect to the outer surface of each of the phosphor portions of the first group.

8. The plasma display panel as claimed in claim 7, further comprising a plurality of barrier ribs arranged between the first substrate and the second substrate to at least partially define respective boundaries of the plurality of discharge cells.

9. The plasma display panel as claimed in claim 7, wherein the phosphor portions of the second group are arranged on the respective portions of a surface of the second substrate facing the first substrate and at least a portion of at least one respective surface of the barrier ribs associated with each of the plurality of discharge cells.

10. The plasma display panel as claimed in claim 1, wherein the phosphor portions of the first group have a thickness that is smaller than a thickness of the phosphor portions of the second group.

11. The plasma display panel as claimed in claim 1, wherein the phosphor portions of the first group have a lower density than a density of the phosphor portions of the second group.

12. The plasma display panel as claimed in claim 1, wherein the first substrate is an image display plane.

13. The plasma display panel as claimed in claim 1, wherein the plurality of electrodes include a plurality of discharge electrodes extending along a first direction on a side of the first substrate facing the second substrate, and address electrodes extending along a second direction on a side of the second substrate facing the first substrate, the first direction perpendicularly crossing the second direction.

14. The plasma display panel as claimed in claim 1, further comprising at least one of:

first barriers arranged on one of the first dielectric layer or an outer surface of the first substrate, the first barriers separating the phosphor portions of the first group from each other; and second barriers arranged on the second dielectric layer, and some of the phosphor portions of the first group cover at least portions of the second barriers and at least portions of the second dielectric layer.

15. The plasma display panel as claimed in claim 1, wherein the phosphor portions of the first group are non-crystalline phosphor portions.

16. A plasma display panel (PDP), comprising:

a first substrate having first and second surfaces facing one another;

a second substrate facing the first surface of the first substrate, the second substrate arranged to be at least partially overlapping with the first substrate;

a plurality of discharge cells arranged between the first substrate and the second substrate;

a plurality of electrodes arranged between the first substrate and the second substrate; and a plurality of phosphor portions including a first group of the plurality of phosphor portions arranged on the first substrate and a second group of the plurality of phosphor portions arranged on the second substrate, the first group of phosphor portions being arranged between the first and second surfaces of the first substrate, and the phosphor portions of the first group and the phosphor portions of the second group being divided by barriers, wherein the barriers separating the phosphor portions of the first group are first barriers, the first barriers having a thickness that is the same as a thickness of the phosphor portions of the first group.

17. The plasma display panel as claimed in claim 16, wherein the first barriers and the first substrate are made of a same material.

18. The plasma display panel as claimed in claim 16, wherein the barriers separating the phosphor portions of the second group are second barriers and the first barriers at least partially overlap the second barriers.

19. A plasma display panel (PDP), comprising:

a first substrate having first and second surfaces facing one another;

a second substrate facing the first surface of the first substrate, the second substrate arranged to be at least partially overlapping with the first substrate;

a plurality of discharge cells arranged between the first substrate and the second substrate;

a plurality of electrodes arranged between the first substrate and the second substrate; and a plurality of phosphor portions including a first group of the plurality of phosphor portions arranged on the first substrate and a second group of the plurality of phosphor portions arranged on the second substrate, wherein the first group of phosphor portions are arranged between the first and second surfaces of the first substrate, and wherein each respective portion of the phosphor portions of the first group is an uninterrupted layer within each discharge cell.

* * * * *